US006322323B1

(12) United States Patent
Komiyama et al.

(10) Patent No.: US 6,322,323 B1
(45) Date of Patent: Nov. 27, 2001

(54) TURBINE MOVABLE BLADE

(75) Inventors: Manabu Komiyama; Yoriharu Murata, both of Yokohama; Toshio Suzuki, Yokosuka, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/210,658

(22) Filed: Dec. 14, 1998

(30) Foreign Application Priority Data

Dec. 15, 1997 (JP) ..... P9-345396

(51) Int. Cl.[7] ..... F01D 1/02
(52) U.S. Cl. ..... 415/200; 416/241 R
(58) Field of Search ..... 415/200; 416/224, 416/229 R, 229 A, 241 B, 241 A, 241 R, 235

(56) References Cited

U.S. PATENT DOCUMENTS 2,456,779 * 12/1948 Goetzel ..... 415/200
2,807,437 * 9/1957 Roush ..... 415/200
3,302,925 * 2/1967 Musick ..... 253/77
3,561,886 * 2/1971 Kreischer, Jr. et al. ..... 416/224
3,660,882 * 5/1972 Widowitz et al. ..... 29/156.8 B
5,351,395 * 10/1994 Crawmer et al. ..... 29/889.7
5,366,345 * 11/1994 Gerdes et al. ..... 416/241 R
6,079,948 * 6/2000 Sasaki et al. ..... 416/235

FOREIGN PATENT DOCUMENTS

536278 * 1/1931 (DE) ..... 416/241
SHO58-220902 12/1983 (JP) .

* cited by examiner

*Primary Examiner*—Edward K. Look
*Assistant Examiner*—James M McAleenan
(74) *Attorney, Agent, or Firm*—Finnegan, Henderson, Farabow, Garrett, & Dunner, L.L.P.

(57) ABSTRACT

A movable blade of a turbine, which has a plurality of stages each provided with movable and stationary blades mounted to a turbine rotor, comprises a movable blade body having a leading edge portion, with respect to a turbine steam flow, and an erosion protective piece which is formed to be continuously integrally with the leading edge portion of the movable blade body so as to be protruded therefrom. The leading edge portion and the erosion protective piece are subjected to a surface hardening treatment such as flame hardening treatment.

9 Claims, 7 Drawing Sheets

TURBINE MOVABLE BLADE

BACKGROUND OF THE INVENTION

The present invention relates to a movable blade of a turbine and in particular, to a turbine movable blade having a leading edge of an improved structure.

Normally, a steam turbine comprises a plurality of stages each provided by combining a turbine stationary blade, which may be called turbine nozzle, and a turbine movable blade, which may be called turbine bucket. A plurality of stages are arranged on a turbine shaft (rotor) along the stream of a turbine driving steam (main stream) and the turbine stationary and movable blades are arranged as an annual sequence along the circumferential direction of the turbine shaft.

Among the plural stages arranged on the turbine shaft, the final stage is driven by wet steam which has lost thermal energy and contains large quantity of droplets, and there may cause a problem of an erosion. The movable blade, in particular, directly receives droplet containing wet steam splashed from the stationary blade arranged upstream thereof. The wet steam may cause erosion to the leading edge thereof, i.e. front side edge with respect to a turbine steam flow. Since the movable blade in the final stage is as long as about 1 m compared with those in the remaining stages and has a greater centrifugal force and vibration stress, if an erosion occurs, there is a fear that a stable operation may be badly affected by the synergistic effect thereof.

FIG. 7 shows a perspective view of a conventional steam turbine, partially cut away, having a plurality of pressure stages to which the present invention is applicable. The shown steam turbine includes a turbine rotor as a rotational shaft 100 around which a plurality of pressure stages such as high pressure stage 101 and low pressure stage 102 (103) are formed. As is generally known in this art field, each pressure stage includes stationary and movable blade unit which are mounted circumstantially to the turbine rotor. The details of the arrangement of these members are well known in the art and detail description thereof is omitted herein.

FIG. 5 shows a conventional movable blade of a turbine, such as shown in FIG. 7, under the strict environment as stated above has been intended to prevent erosion caused by the wet steam, by attaching, for example, welding an erosion shield plate 3 made of high erosion protective material such as, for example, cobalt group alloy steel onto a leading edge 2 of the main body of the movable blade 1 (called hereinlater movable blade body 1 or merely blade body 1) with silver brazing or welding. That is, a portion of the leading edge of the movable blade body is formed to have a recessed portion into which the erosion shield piece is welded as a separate member.

However, when such silver brazing or welding is applied, a connection defect occurs to or a residual stress remain in the base material of the blade body 1. After the movable blade has been used for a long period of time, the erosion shield plate 3 may be peeled off. Besides, if the erosion shield plate is replaced repeatedly, various problems including occurrence of fatigue to the base material of the blade body I are caused due to a thermal effect. Considering this, the following measures have been taken for the recent movable blade as shown in FIG. 6, which is also applicable to a steam turbine of FIG. 7. When the erosion shield piece 3*a* is attached to the leading edge 2 of the blade body 1, surface flame hardening is locally conducted to the blade body 1 and the erosion shield piece 3*a* to maintain high strength, thereby preventing erosion by the wet steam.

As described above, in the recent turbine movable blade, the surface flame hardening is conducted instead of junction means such as welding when the erosion shield piece 3*a* is attached to the leading edge 2 of the blade body 1. Accordingly, welding defects, liftoff and the like can be suppressed and the movable blade can be thus operated while maintaining the quality thereof in a stable condition even under the severe circumstances.

Normally, 12-chromium alloy steel is often used for the base material of the blade body 1 in the movable blade. In that case, since there are portions subjected to flame hardening and portions not subjected to the flame hardening between the erosion shield piece 3*a* and the 12-chromium alloy steel, a residual tensile force might sometimes occur. For this reason, the portions of the movable blade body subjected to the flame hardening are often cracked by stress corrosion crack or fatigue, which has made it difficult to maintain the quality of the movable blade in a stable condition.

To suppress the residual tensile stress generated at the 12-chromium alloy steel, there is proposed, for example, conducting of a shot peening to portions subjected to the flame hardening. This, however, is not a durable measure to maintain stable quality of the movable blade body.

SUMMARY OF THE INVENTION

An object of the present invention is to substantially eliminate defects or drawbacks encountered in the prior art mentioned above and to provide a movable blade of a turbine having an improved structure capable of further reducing a residual tensile stress generated at a base material of a movable blade main body and maintaining the quality of the movable blade in a stable condition, even if an erosion protective piece is attached to the blade body and surface hardening is conducted.

This and other objects can be achieved according to the present invention by providing, in one aspect, a movable blade of a turbine, which has a plurality of stages each provided with movable and stationary blades mounted to a turbine rotor, comprising a movable blade body having a leading edge portion on an upstream side with respect to a turbine steam flow and an erosion protective piece which is formed to be continuously integrally with the movable blade body so as to be protruded from the blade body, wherein the leading edge portion and the erosion protective piece are subjected to a surface hardening treatment such as flame hardening treatment.

In a preferred embodiment of this aspect, the erosion protective piece has a length in a longitudinal direction of the movable blade body in a range of 10% to 45% of an effective length of the movable blade body and a depth in a width direction thereof is set to be at least 1 mm or more.

In another aspect, there is provided a movable blade of a turbine, which has a plurality of stages each provided with movable and stationary blades mounted to a turbine rotor, comprising a movable blade body having a leading edge portion on an upstream side with respect to a turbine steam flow and an erosion protective piece which is formed to be continuously integrally with the movable blade body, wherein the erosion protective piece is protruded, in the upstream of the turbine steam f low, over a segment cover provided between a top portion of one of movable blade body and a top portion of another one of movable blade body adjacent to the one movable blade body.

In a further aspect, there is provided a movable blade of a turbine, which has a plurality of stages each provided with movable and stationary blades mounted to a turbine rotor, comprising a movable blade body having a leading edge portion on an upstream side with respect to a turbine steam flow and an erosion protective piece which is formed to be continuously integrally with the movable blade body so as to be protruded from the leading edge of the blade body, wherein the erosion protective piece has a base edge portion from which the erosion protective piece is protruded from the movable blade body, and a distance between the base edge portion and an outside edge portion of a tenon hole formed so as to join a blade cover disposed between a top portion of one of the movable blade body and a top portion of another one of the movable blade body adjacent to the one movable blade body is set at least 2 mm or more.

In a preferred embodiment of this aspect, the erosion protective piece is protruded over the location of the blade cover in the upstream side of the turbine steam flow. The movable blade body has a portion formed as an extension at the top portion thereof and the tenon hole is formed to the extension.

In all the aspects, the erosion protective piece is applied to all of the movable blades of the plural stages of the turbine.

As described above, in the turbine movable blade according to the present invention, an erosion protective piece is formed continuously integrally with the leading edge of the blade body so as to be protruded from the blade body. Accordingly, even if the surface flame hardening is conducted to the leading edge and the erosion protective piece, it is possible to maintain the quality of the blade body in a stable condition.

Moreover, according to the embodiments of the present invention, the erosion protective piece is provided at the leading edge of the movable blade body, thus ensuring that a segment cover is protected from droplets contained in the steam.

Furthermore, according to the embodiments of the present invention, the erosion protective piece is provided at the leading edge of the blade body and the length between the base edge of the erosion protective piece and the edge of the tenon hole provided at the blade extension portion of the top portion of the blade body is set to be at least 2 mm or more. Accordingly, even if the surface flame hardening is conducted to the erosion protective piece, it is possible to prevent the edge of the tenon hole from cracking, thus exhibiting excellent advantages.

The nature and further characteristic features of the present invention will be made more clear from the following descriptions made with reference to the accompanying drawings.

DESCRIPTION OF THE PREFERRED EMBODIMENTS

Embodiments of a turbine movable blade according to the present invention will be described hereunder with reference to the accompanying drawings.

Figure 1:
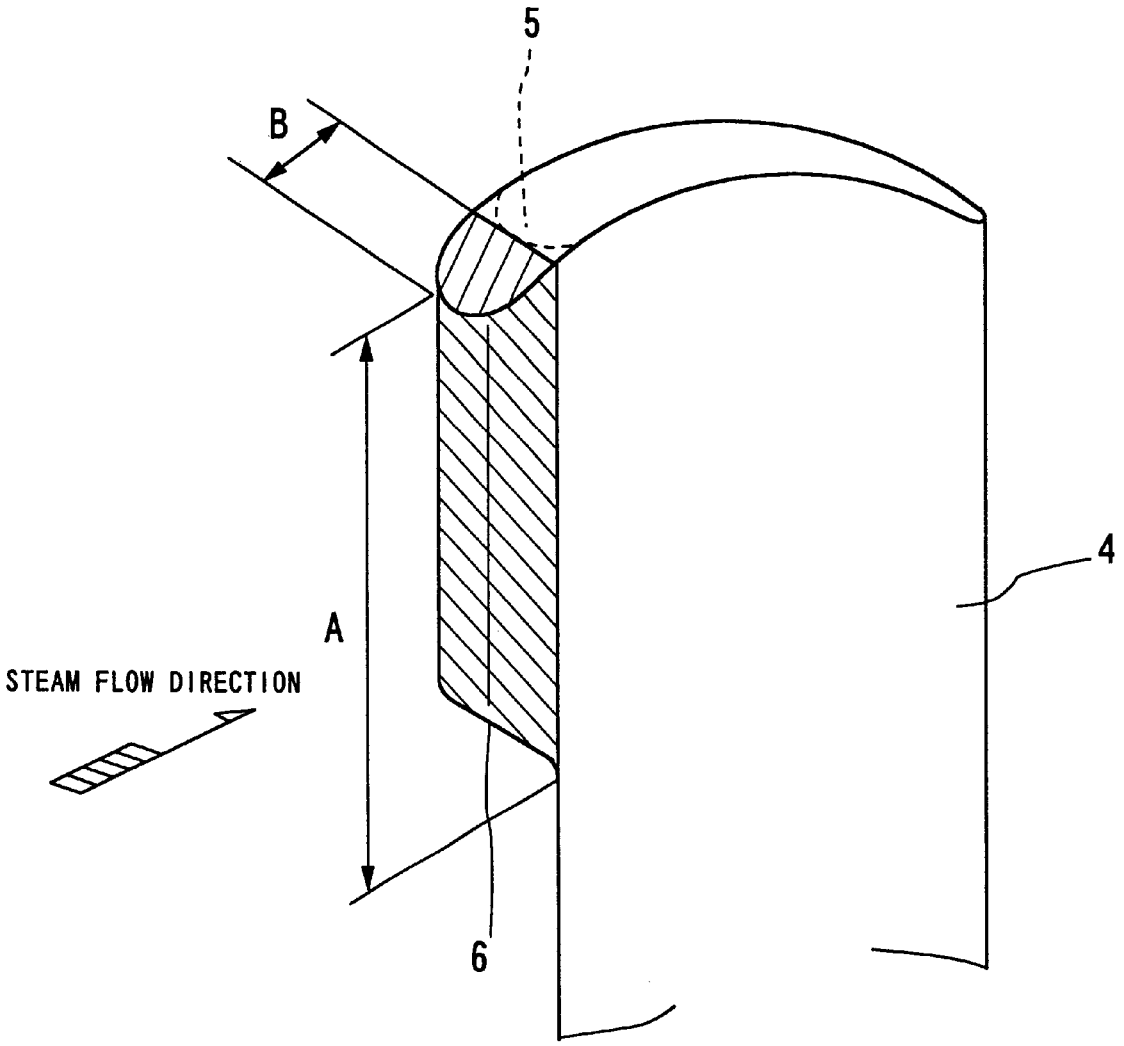
FIG. 1 is a schematic view showing a first embodiment of a turbine movable blade according to the present invention.

FIG. 1 is a schematic view showing the first embodiment of the turbine movable blade according to the present invention.

Figure 7:
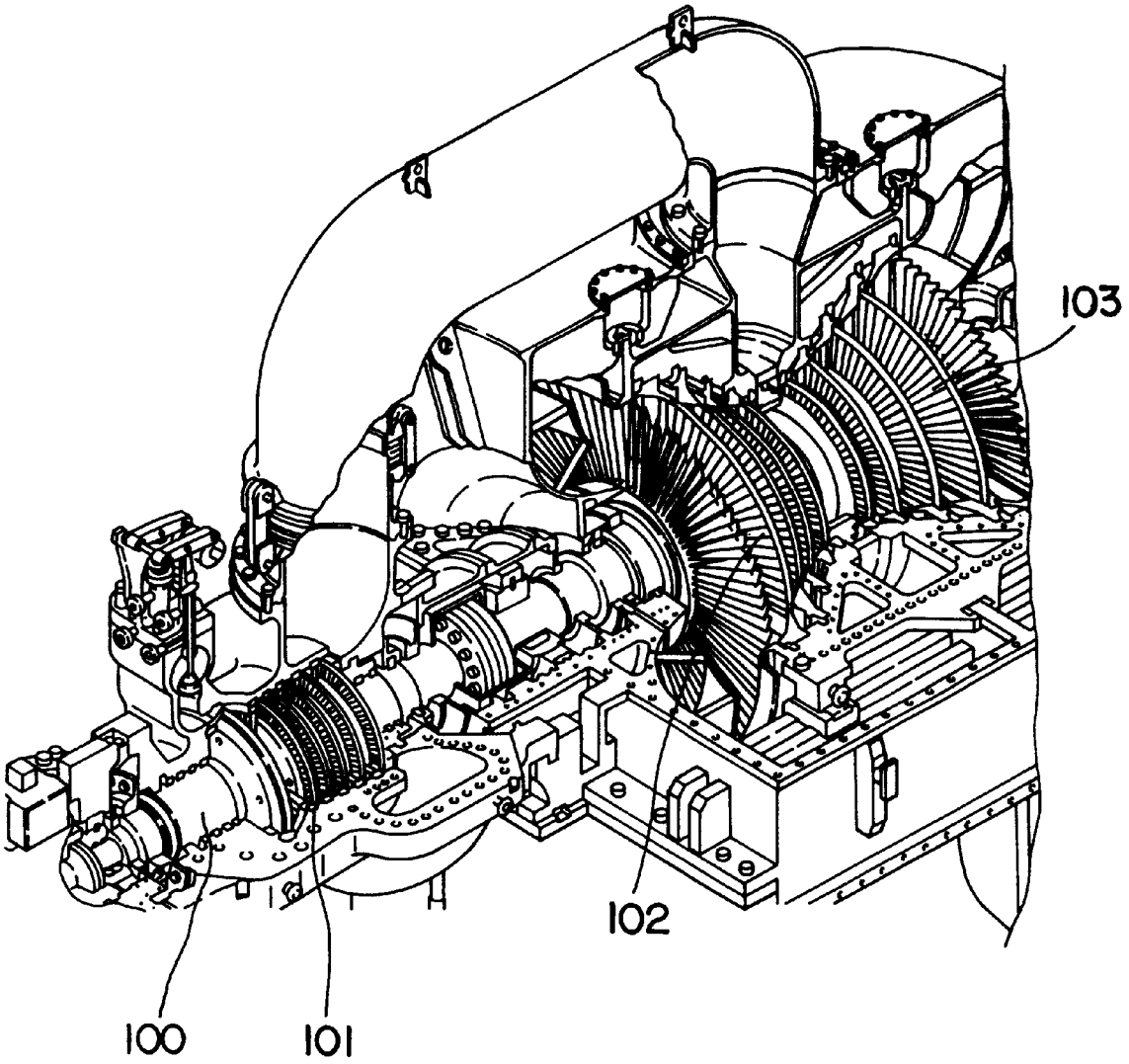
FIG. 7 PRIOR ART
FIG. 7 is a perspective view of a conventional steam turbine, partially cut away, to which the present invention is applicable.

A turbine is generally provided with a plurality of stages each comprising movable and stationary blades. This general arrangement is substantially the same as that shown in FIG. 7, to which this embodiment is applicable.

The turbine movable blade in this embodiment has a structure in which an erosion protective piece 6 is formed continuously integrally with a leading edge 5 of a movable blade main body 4 (merely called movable blade body or simply, blade body 4, hereinlater) formed to a front portion of the movable blade body with respect to a turbine steam flow so as to protrude upstream side from the leading edge. The movable blade body and the erosion protective piece are formed together through a molding process, for example. A length A in blade height (longitudinal) direction of the protective piece 6 is set to fall within a range of 10% to 45% of the effective length (which is a length from the blade base to the blade tip) of the blade main body and a depth B in a width direction thereof is set to be at least 1 mm or more.

As can be seen from the above, in this embodiment, the erosion protective 6 is protruded continuously integrally with the leading edge 5 of the blade body 4 and the length A is set to fall within a range of 10% to 45% of the effective length of the blade body and the depth B thereof is set to be at least 1 mm or more. Accordingly, at a time when the surface flame hardening is conducted to the erosion protective piece 6 and the leading edge 5, it is possible to hold down a residual tensile force generated at the blade body 4 to a low value regardless of the fact that there exist portions subjected to the flame hardening and portions not subjected to the flame hardening during the treatment.

According to this embodiment, therefore, if the surface flame hardening is conducted to the erosion protective piece 6 and the leading edge 5, the base material of the blade body 4 is not given a thermal effect since the erosion protective piece 6 is formed integrally with the leading edge 5 so as to be protruded. It is therefore possible to maintain the quality of the movable blade body 4 in a stable condition.

Figure 2:
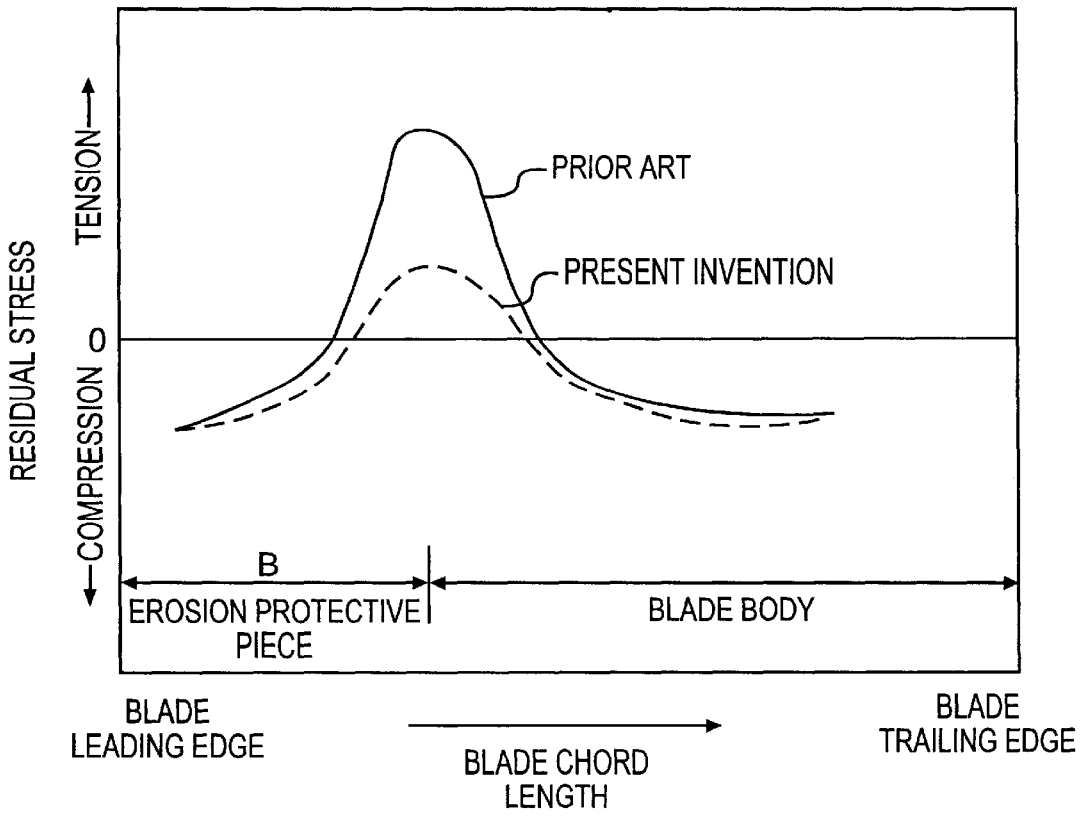
FIG. 2 is a graph showing the comparison of residual tensile force generated at the turbine movable blade of the present invention with the conventional turbine movable blade.

In FIG. 2, the axis of ordinates indicates a tensile stress value on the upper side and a compressive stress value with reference to a zero stress value, whereas the axis of abscissas indicates the distance (blade code) from the leading edge of the erosion protective piece to the trailing edge (base edge) of the blade body. It is noted that the turbine movable blade according to this embodiment can be applied to all turbine stages although description is only given to the application of the turbine movable blade to the final stage.

Figure 3:
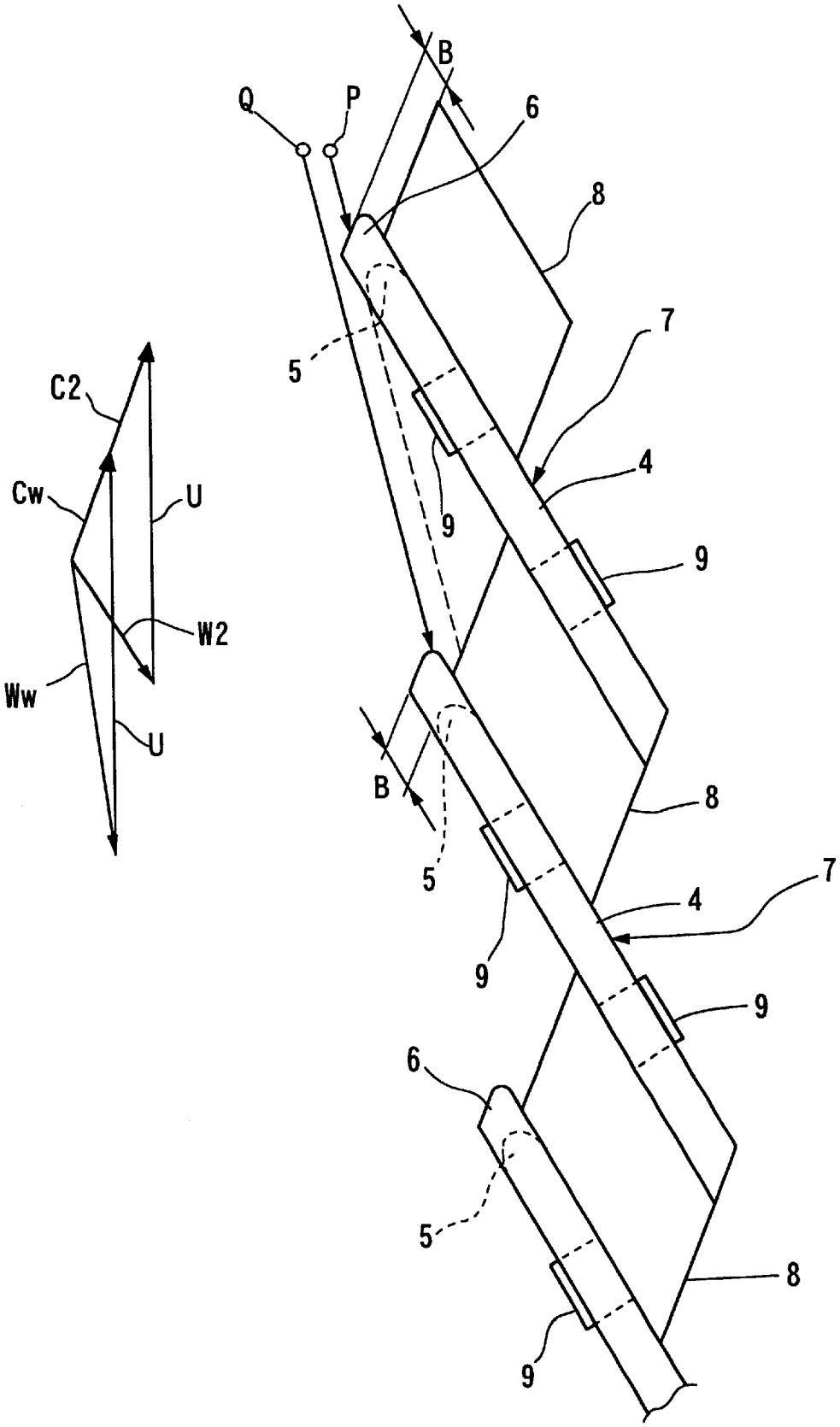
FIG. 3 is a schematic plan view showing a second embodiment of the turbine movable blade according to the present invention.

FIG. 3 is schematic plan view showing a second embodiment of the turbine movable blade according to the present invention.

The turbine movable blade in this embodiment has a structure in which an erosion protective piece 6 is provided to be formed to be protruded continuously integral) with the leading edge 5 of the blade body 4 and in which a segment cover 8 is provided on the blade top portion 7. The segment cover 8 is intended to suppress vibration generated during the rotation of the blade body 4. Reference numeral 9 denotes an ejector part (lug) provided in the middle of the blade body 4 in the blade length direction and used for suppressing vibration.

Normally, in the vicinity of the final stage of the turbine into which steam of high wetness flows, if it is assumed that the absolute velocity of the steam flowing into the blade body 4 is C2, the peripheral velocity of the blade element main body 4 is U and the relative velocity is W2, then the velocity triangle is as shown in FIG. 3. If it is also assumed that the absolute velocity of droplets P and Q flowing into the erosion protective piece 6 of one movable blade body 4 and the erosion protective piece 6 of the adjacent movable blade body 4, respectively is Cw and the relative velocity is Ww, the absolute velocity Cw of the droplets P and Q is slower than that of the steam since the particle diameter of a droplet generated from the turbine stationary blade (nozzle) arranged upstream of the turbine movable blade with respect to the turbine steam flow is large and attrition occurs while the droplet flows along the blade surface. The relative velocity Ww of the droplets P and Q is higher than that of the steam since the peripheral velocity U of the blade body 4 is the same.

If the absolute velocity Ww of the droplets P and Q is high, the impact forces thereof is high accordingly and erosion protective measures needs to be taken for the segment cover 8. In this embodiment, however, the erosion protective piece 6 is provided continuously integrally with the leading edge 5 of the blade body 4 and the erosion protective piece 6 is protruded upstream with respect to the segment cover 8. Accordingly, it is possible for the erosion protective piece 6 to receive the impact force to thereby protect the segment cover B.

According to this embodiment, therefore, the turbine movable blade is designed for the erosion protective piece 6 to receive the impact force of the droplets P and Q. thereby making it possible to maintain the quality of the segment cover 8 in a stable condition.

Figure 4:
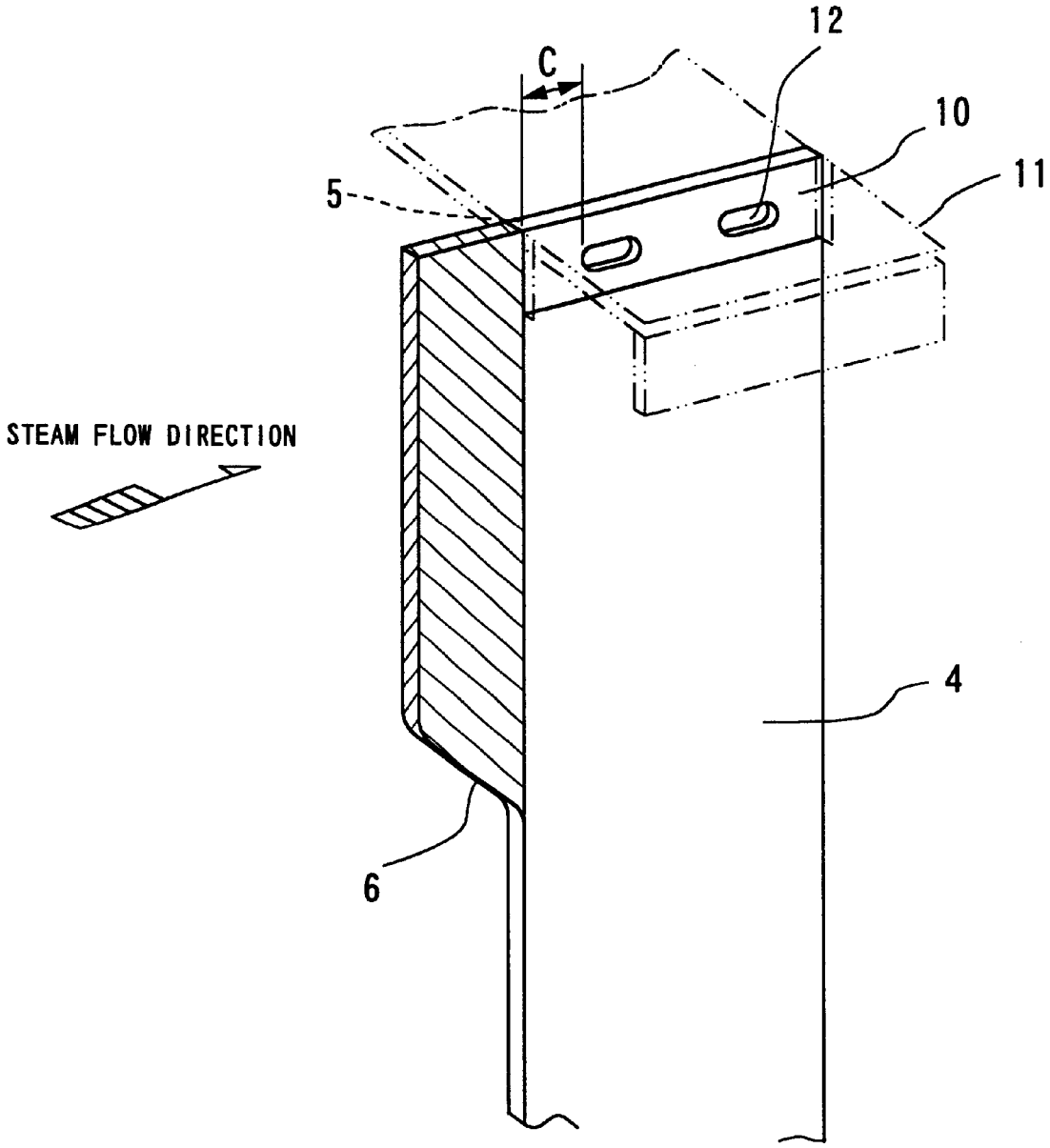
FIG. 4 is a schematic view showing a third embodiment of the turbine movable blade according to the present invention.
Figure 5:
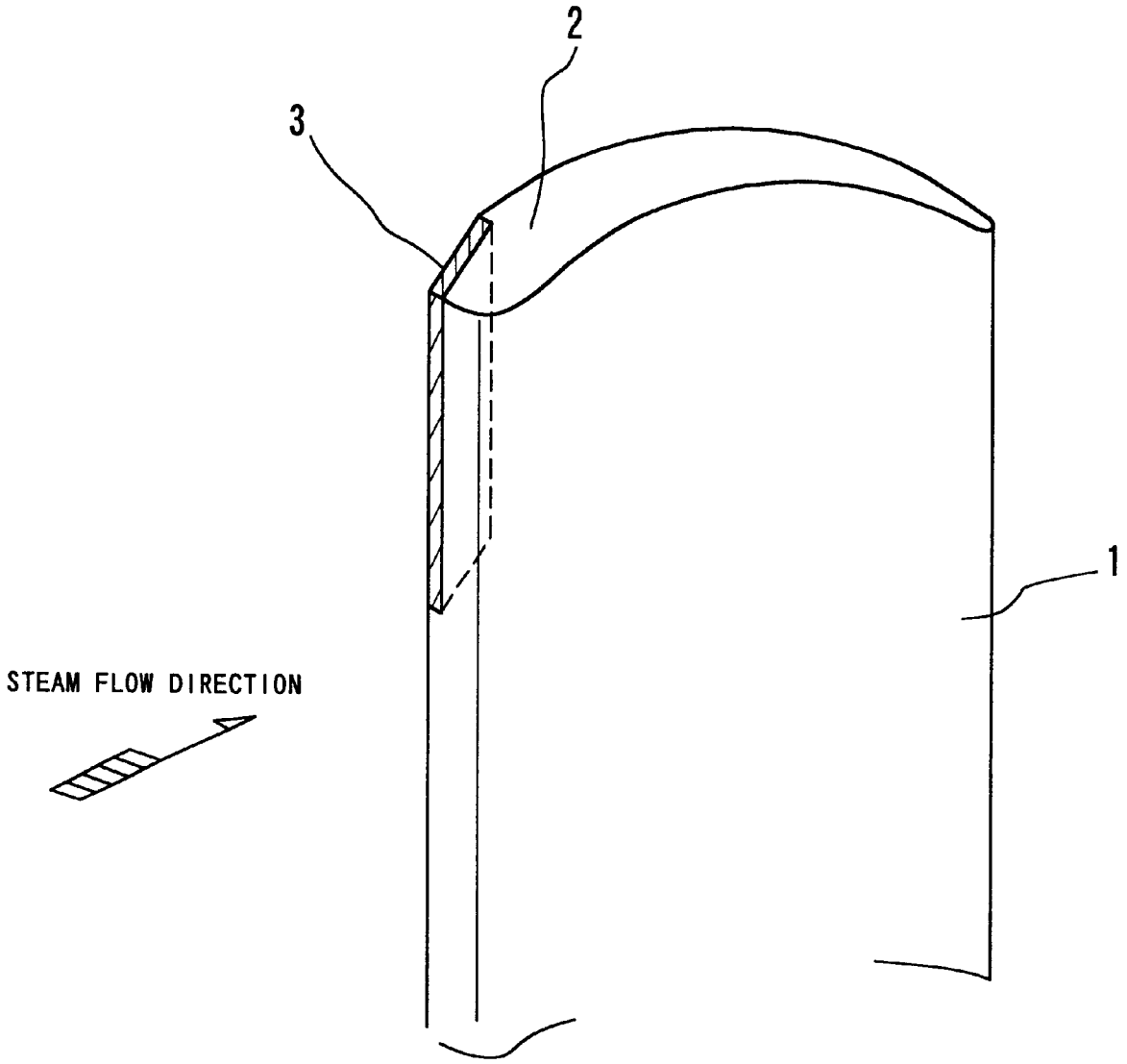
FIG. 5 PRIOR ART
FIG. 5 is a schematic view showing a conventional turbine movable blade.
Figure 6:
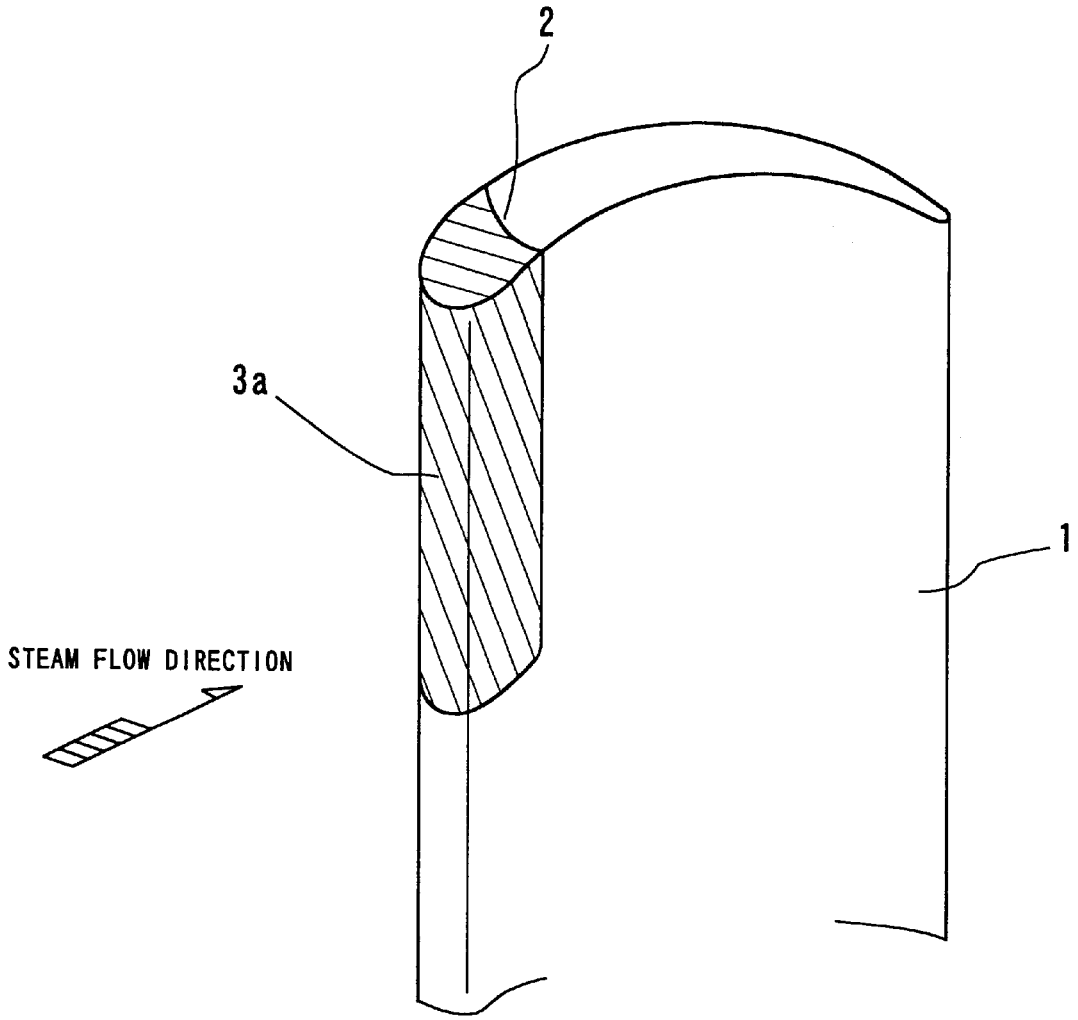
FIG. 6 PRIOR ART
FIG. 6 is a schematic view showing a further conventional turbine movable blade.

FIG. 4 is a schematic view showing a third embodiment of the turbine movable blade according to the present invention, and in FIG. 4, although the movable blade 4 is schematically shown like a plate member for the sake of convenience, the movable blade 4 in this embodiment has an actual shape of that shown in FIG. 1.

The turbine movable blade in this embodiment has a structure in which an erosion protective piece 6 is formed to be continuously integral with the leading edge 5 of the blade body 4 so as to be protruded, a damping blade cover 11 is provided at the blade top portion extending piece 10 (blade extension) formed continuously integrally with the top portion of the blade body 4 and in which the erosion protective piece 6 is ejected upstream with respect to the blade cover 11.

Conventionally, in the turbine movable blade, a blade cover 11 is provided between the blade extension 10 of the blade body 4 of one of movable blades and the blade extension 10 of the blade body 4 of another one of movable blades adjacent to the former one, a tenon (not shown) is caulked via a tenon hole 12 piercing through the blade top portion extension 10 to join the blade cover 11 and to suppress the vibration of the blade body 4 generated during operation. In this case, if the surface flame hardening is conducted to the leading edge 5 of the blade body 4 without the provision of the erosion protective piece 6, then the tenon hole 12 is given a thermal effect and a crack such as a brake occurs to the edge.

Under those circumstances, in this embodiment, the length C from the edge of the tenon hole 12 to the base edge of the erosion protective piece 6 is set to be at least not less than 2 mm to thereby allow the tenon hole 12 to be given a less thermal effect deriving from the flame hardening. It can be ensured that the tenon hole 12 is protected from the effect.

As described above, in the turbine movable blade according to the present invention, an erosion protective piece is protruded from and integrally with the leading edge of a movable blade body. Accordingly, even if the surface flame hardening is conducted to the leading edge and the erosion protective piece, it is possible to maintain the quality of the movable blade body in a stable condition.

It is to be noted that the present invention is not limited to the described embodiments and many other changes and modifications may be made without departing from the scopes of the appended claims.

What is claimed is:

1. A movable blade of a multi-stage turbine having movable and stationary blades in each stage mounted to a turbine rotor, the movable blade comprising:

a movable blade body having a front portion with respect to turbine fluid flow; and an erosion protective piece protruding from the front portion of the movable blade body, wherein the erosion protective piece and the movable blade body are formed together from the same material to form a one-piece member wherein only said erosion protective piece is subjected to a surface hardening treatment.

2. The movable blade of claim 1, wherein said erosion protective piece is has a length in longitudinal direction of the movable blades body in a range of 10% to 45% of an effective length of the movable blade body and a depth in a width direction of the movable blade body is set to be at least 1 mm.

3. The movable blade of claim 1, wherein said movable blade body includes a first end portion mounted to the turbine rotor and a second end portion apart from the first end portion, and wherein said erosion protection piece is formed on the front portion and the second end portion of the movable blade body.

4. The movable blade of claim 1, wherein said erosion protective piece is on all of the movable blades of each of the stages of the turbine.

5. The movable blade of claim 1, wherein said surface hardening treatment is a flame hardening treatment.

6. A movable blade of a multi-stage turbine having movable and stationary blades in each stage mounted to a turbine rotor, the movable blade comprising:

a movable blade body having a front portion with respect to turbine fluid flow; and an erosion protective piece protruding from the front portion on the upstream side with respect to the turbine fluid flow, over a segment cover provided between a top portion of the movable blade body and a top portion of an adjacent blade body of another movable blade in the turbine, wherein the erosion protective piece and the movable blade body are formed together from the same material to form a one-piece member, wherein only said erosion protective piece is subjected to a surface hardening treatment.

7. A movable blade of a multi-stage turbine having movable and stationary blades in each stage mounted to a turbine rotor, the movable blade comprising:

a movable blade body having a front portion with respect to a turbine fluid flow and at least one tenon hole for joining a blade cover disposed between a top portion of the movable blade body and a top portion of an adjacent blade body of another blade in the turbine; and an erosion protective piece protruding from the front portion of the movable blade body, wherein said erosion protective piece and said movable blade body are formed together from the same material to form a one-piece member, wherein said erosion protective piece has a base edge portion adjacent to the movable blade body and wherein a distance between the base edge portion of the erosion protective piece and a side of the tenon hole proximal to the base edge portion is at least 2 mm, wherein only said erosion protective piece is subjected to a surface hardening treatment.

8. The movable blade of claim 7, wherein said movable blade body protrudes over the location of said blade cover in the upstream side of the turbine fluid flow.

9. The movable blade of claim 7, wherein said movable blade body has a portion formed as an extension at the top portion thereof and said at least one tenon hole is formed in the extension.

* * * * *

UNITED STATES PATENT AND TRADEMARK OFFICE

CERTIFICATE OF CORRECTION

PATENT NO. : 6,322,323 B1
DATED : November 27, 2001
INVENTOR(S) : Manabu Komiyama et al.

It is certified that error appears in the above-identified patent and that said Letters Patent is hereby corrected as shown below:

Column 6,
Line 37, change "piece is" to -- piece --; and after "length in" insert -- a --; and
Line 38, change "blades body" to -- blade body --.

Signed and Sealed this

Seventh Day of May, 2002

*Attest:*

*Attesting Officer*

JAMES E. ROGAN
*Director of the United States Patent and Trademark Office*